US007626373B2

(12) United States Patent
Mayell

(10) Patent No.: US 7,626,373 B2
(45) **Date of Patent: *Dec. 1, 2009**

(54) METHOD AND APPARATUS FOR A VOLTAGE TRIGGERED CURRENT SINK CIRCUIT

(75) Inventor: Robert J. Mayell, San Francisco, CA (US)

(73) Assignee: Power Integrations, Inc., San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/188,098

(22) Filed: Aug. 7, 2008

(65) Prior Publication Data

US 2008/0290910 A1 Nov. 27, 2008

Related U.S. Application Data

(63) Continuation of application No. 11/392,011, filed on Mar. 29, 2006, now Pat. No. 7,443,153.

(51) Int. Cl.
*G05F 3/04* (2006.01)

(52) U.S. Cl. ..... 323/312

(58) Field of Classification Search ..... 323/312, 323/313, 314, 356; 327/538, 542
See application file for complete search history.

(56) References Cited

U.S. PATENT DOCUMENTS

| | | | |
|---|---|---|---|
| 5,014,178 | A | 5/1991 | Balakrishnan |
| 5,754,038 | A | 5/1998 | Durec et al. |
| 6,147,883 | A | 11/2000 | Balakrishnan et al. |
| 6,738,277 | B2 | 5/2004 | Odell |
| 6,795,321 | B2 | 9/2004 | Balakrishnan et al. |
| 6,949,972 | B1 | 9/2005 | Knight |
| 7,248,097 | B2 | 7/2007 | Montgomery |
| 7,443,153 | B2 * | 10/2008 | Mayell ..... 323/312 |

FOREIGN PATENT DOCUMENTS

EP 0 529 633 A 3/1993

OTHER PUBLICATIONS

"LTC4257—IEEE 802.3af PD, Power Over Ethernet Interface Controller," Linear Technology Corporation, 2003, pp. 1-20.

"IEEEStd 802.3af™: IEEE Standard for Information Technology—Telecommunications and Information Exchange Between Systems—Local and Metropolitan Area Networks—Specific Requirements; Part 3: Carrier Sense Multiple Access with Collision Detection (CSMA/CD) Access Method and Physical Layer Specifications; Amendment: Data Terminal Equipment (DTE) Power via Media Dependent Interface (MDI)," IEEE Computer Society, Jun. 18, 2003, pp. i-x, 1-121.

"MAX5941A/MAX5941B—IEEE 802.3af-Compliant Power-Over-Ethernet Interface/PWM Controller for Power Devices," Maxim Integrated Products, Rev. 0, Oct. 2003, pp. 1-24.

(Continued)

*Primary Examiner*—Adolf Berhane
(74) *Attorney, Agent, or Firm*—Blakely Sokoloff Taylor & Zafman LLP

(57) ABSTRACT

A current sink circuit is disclosed. An apparatus according to aspects of the present invention includes a sensing element, a pass element coupled to the sensing element and a setting element coupled to the pass element. The setting element provides both a voltage threshold level and a current regulation reference. The pass element is to pass current conducted through the current sink circuit in response to the setting element. The current conducted through the current sink circuit is substantially zero when a voltage applied across the current sink circuit is below the voltage threshold level. A signal generated by the sensing element is regulated in response to the current regulation reference by regulating a current conducted through the pass element when a voltage applied across the current sink circuit is above the voltage threshold level.

12 Claims, 6 Drawing Sheets

OTHER PUBLICATIONS

"HV110—Power-over-Ethernet Interface PD Controller Meets IEEE8O2.3af™ Standard," Supertex Inc., Rev. 1.2, Dec. 15, 2003, pp. 1-10.

"TPS2375; TPS2376; TPS2377—IEEE 802.3af PoE Powered Device Controllers," Texas Instruments, Inc., Apr. 2004, Revised Sep. 2004, pp. 1-18 and addendum.

"Design Idea DI-88—DPA-Switch® PoE Detection and Classification (Class 0-3) Interface Circuit," Power Integrations, Inc., Aug. 2005, pp. 1-2.

EP 06 25 6396—European Search Report, dated Aug. 20, 2007 (Publication No. EP 1 840 693).

* cited by examiner

METHOD AND APPARATUS FOR A VOLTAGE TRIGGERED CURRENT SINK CIRCUIT

REFERENCE TO PRIOR APPLICATION

This application is a continuation of U.S. application Ser. No. 11/392,011, filed Mar. 29, 2006, now pending, entitled "Method and Apparatus for a Voltage Triggered Current Sink Circuit," the entire contents of which is hereby incorporated by reference.

BACKGROUND OF THE INVENTION

1. Field of the Invention

The present invention relates generally to circuits, and more specifically, to voltage triggered current sink circuits where the sink current is regulated when the voltage applied across the current sink circuit exceeds a voltage threshold level.

2. Background Information

In certain applications of electronic circuits it is desirable to sink a regulated current from a power source providing a supply voltage applied across the circuit. Furthermore, in certain applications it is required to regulate this sink current only when the voltage applied across the circuit exceeds a voltage threshold level. At voltages below this voltage threshold level, the current sink circuit may be designed to conduct substantially zero current in order to reduce power consumption from the supply or as part of a classification/recognition procedure.

An example of such a classification/recognition procedure is part of the IEEE 802.3af standard. This standard describes the classification/recognition characteristics that must be displayed by electronic equipment connected to a power source that uses Ethernet cabling as a means to apply a supply voltage to the electronic equipment. In such applications, according to the IEEE 802.3af standard, as part of the operation of the electronic equipment receiving a supply voltage from the Ethernet cable, the electronic equipment must include a current sink circuit designed to sink a regulated current over a range of supply voltages applied across the current sink circuit. The current sink circuit used for this purpose should sink substantially zero current at voltages below a threshold value. The current sink circuit employed therefore must be responsive to the voltage applied across it to act as a voltage triggered current sink circuit. Known circuits that exhibit these characteristics include a voltage threshold setting element and a separate current regulation reference element.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DETAILED DESCRIPTION

Examples of apparatuses and methods for implementing an improved voltage triggered current sink circuit are disclosed. In the following description, numerous specific details are set forth in order to provide a thorough understanding of the present invention. It will be apparent, however, to one having ordinary skill in the art that the specific detail need not be employed to practice the present invention. Well-known methods related to the implementation have not been described in detail in order to avoid obscuring the present invention.

Reference throughout this specification to "one embodiment" or "an embodiment" means that a particular feature, structure or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures or characteristics may be combined in any suitable manner of combinations or sub-combinations in one or more embodiments in accordance with the teachings of the present invention.

An improved voltage triggered current sink circuit and method for implementing such a circuit in accordance with the teachings of the present invention is disclosed. Examples of the present invention involve methods and apparatuses that simplify a voltage triggered current sink circuit such that a single circuit element combines both the current regulation reference and voltage threshold level setting functions. Throughout the specification, circuits coupled to direct current (DC) power sources are disclosed by way of example. The techniques disclosed may however be applied to circuits designed to receive alternating current (AC) voltages with the inclusion of a suitable rectification stage to convert AC to a DC supply voltage in accordance with the teachings of the present invention.

Figure 1:
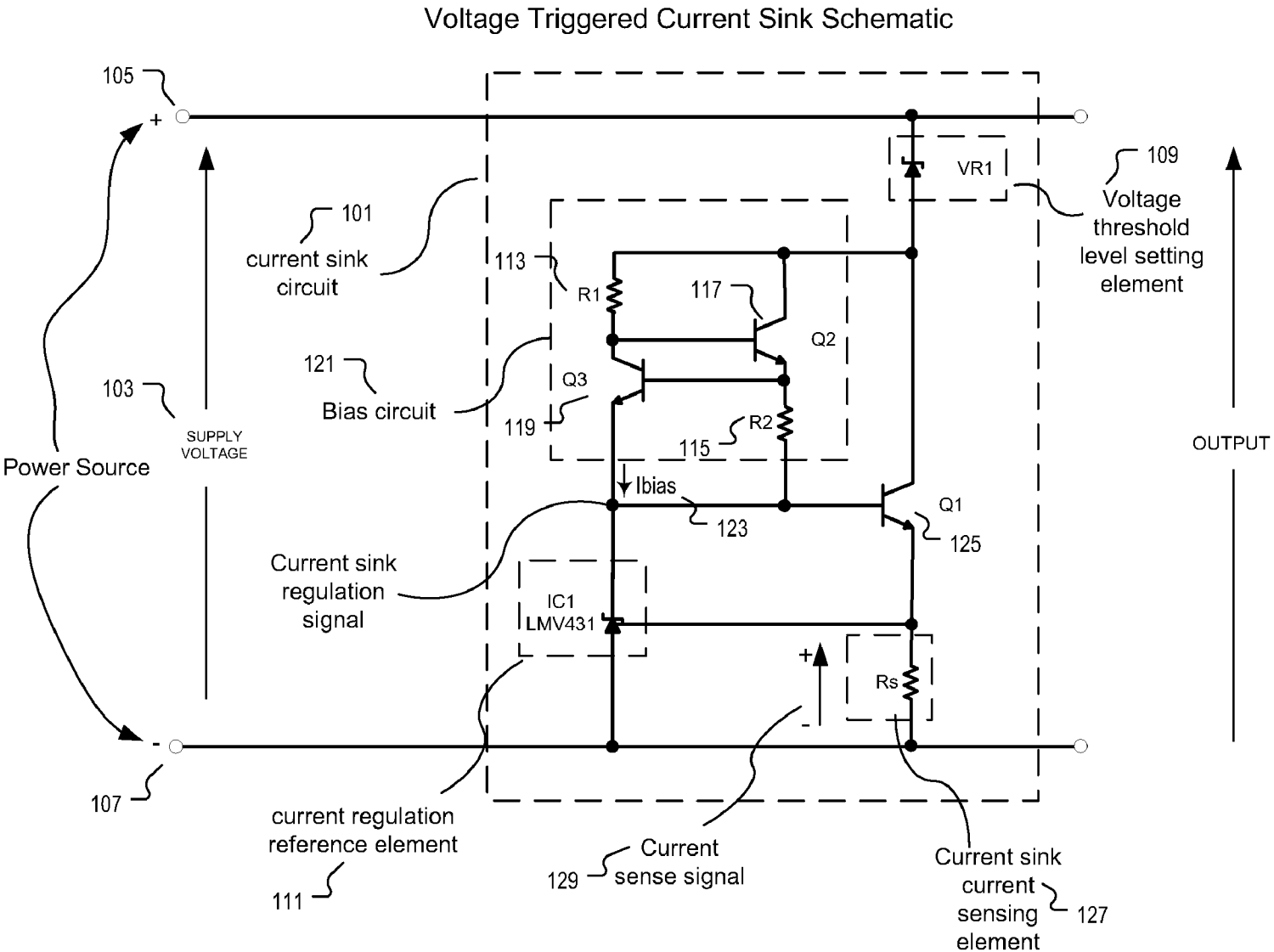
FIG. 1 is an example schematic diagram of a voltage triggered current sink circuit having separate voltage threshold level setting and current regulation reference elements.

FIG. 1 shows a schematic diagram of one example of a voltage triggered current sink circuit 101. The voltage triggered current sink circuit 101 is coupled to receive a DC supply voltage 103 from a power source coupled between the input terminals 105 and 107 of the voltage triggered current sink circuit 101. As shown in the depicted example, the voltage triggered current sink circuit 101 employs a first circuit element Zener diode VR1 109 to set a voltage threshold at which supply voltage the circuit will begin to sink current and a second separate circuit element precision reference IC1 111 to set a current regulation reference which will determine the regulation level of the current which is drawn from the power source. A bias circuit 121 including resistors R1 113 and R2 115 and transistors Q2 117 and Q3 119 form a simple bias current source circuit which provides a bias current $I_{bias}$ 123 for precision reference IC1 111 to ensure it operates within the manufacturer's specifications. It is appreciated that the bias circuit 121 formed with resistors R1 113 and R2 115 and transistors Q1 117 and Q2 119 is only one example of a bias circuit that can be used to provide bias current $I_{bias}$ 123 and a number of alternative bias circuit configurations could be used including a single transistor or resistor.

In the illustrated example, the voltage triggered current sink circuit 101 of FIG. 1 conducts substantially zero current until the DC supply voltage 103 exceeds a threshold set by Zener diode VR1 109. At DC supply voltages 103 above this voltage threshold, current flows in Zener diode VR1 109 and the bias circuit 121 provides bias current $I_{bias}$ 123 to bias precision reference IC1 111 and the base of transistor Q1 125, allowing current to flow in current sink sensing element resistor Rs 127. In the illustrated example, current sense signal 129 indicates the voltage across the current sink current sensing element, resistor Rs 127. When the voltage developed across resistor Rs 127 rises to a reference voltage level of precision reference IC1 111, IC1 111 regulates the current flowing in the base of transistor Q1 125, the current flowing through Zener diode VR1 109 and therefore from the power source at this level. In this example, the reference voltage level of IC1 111 is the current regulation reference.

Thus, the current conducted through the voltage triggered current sink circuit 101 starts to rise when the DC supply voltage applied across the current sink circuit 101 exceeds the voltage threshold level determined by Zener diode VR1 109 and is regulated at a substantially constant value for a range of voltages applied across the voltage triggered current sink circuit 101 greater than the voltage threshold determined by Zener diode VR1 109. The actual voltage at which the current sink value is fully regulated is actually a function of the collector to emitter voltage of transistor Q1 125 and any voltage drop across resistor Rs 127. The range of voltages applied across the voltage triggered current sink circuit 101 over which the sink current is regulated to a substantially constant value depends on the application. For example, transistor Q1 125 could be turned off at some higher DC supply voltage 103 to limit the power dissipation in the current sink circuit 101. The circuitry used to turn off the current sink circuit 101 is not shown so as not to obscure the teachings of the present invention.

Figure 2:
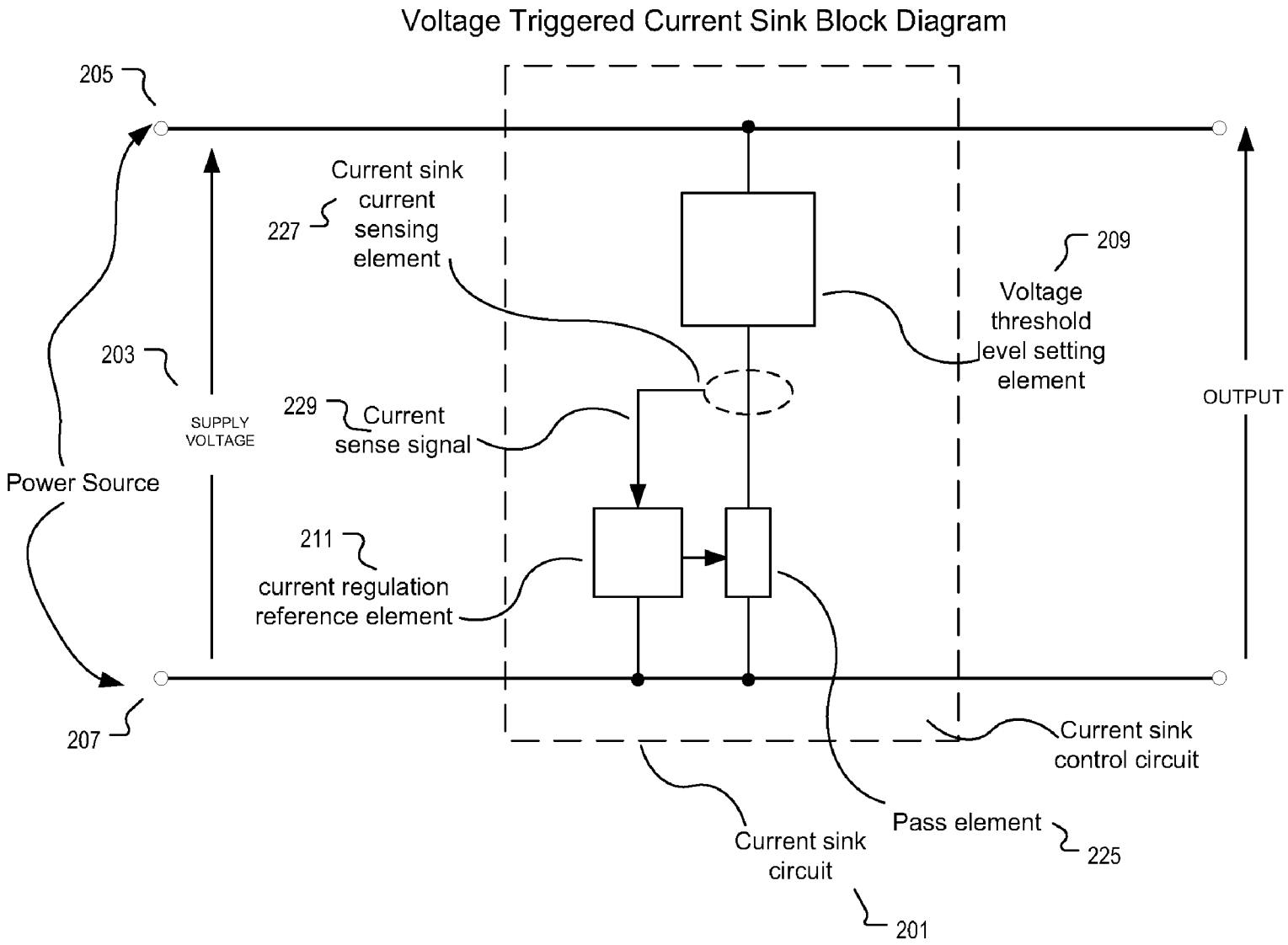
FIG. 2 is an example block diagram of a voltage triggered current sink circuit having separate voltage threshold level setting and current regulation reference elements.

FIG. 2 shows an example block diagram of a voltage triggered current sink circuit 201 having separate elements setting a voltage threshold level and a current regulation reference voltage level. The various blocks illustrated in FIG. 2 are analogous to the similarly labeled blocks of the example voltage triggered current sink circuit 101 schematic of FIG. 1. In particular, voltage triggered current sink circuit 201 includes input terminals 205 and 207 coupled to a power source to receive DC supply voltage 203. A voltage threshold level setting element 209 is coupled to the input terminal 205 with a current sink current sensing element 227 and a pass element 225 coupled to the voltage threshold level setting element 209. A current regulation reference element is coupled to receive a current sense signal 229 from the current sink current sensing element 227. The pass element 225 is coupled to the current regulation reference element 211, which controls the current flow through the current sink sensing element 227 by controlling the pass element 225. In the example illustrated in FIG. 2, it is appreciated that the pass element 225 corresponds to the transistor Q1 125 of FIG. 1. In another example, it is appreciated that a field effect transistor (FET) could also be used as a pass element 225 in place of the example bipolar transistor Q1 125 illustrated in FIG. 1.

Figure 3:
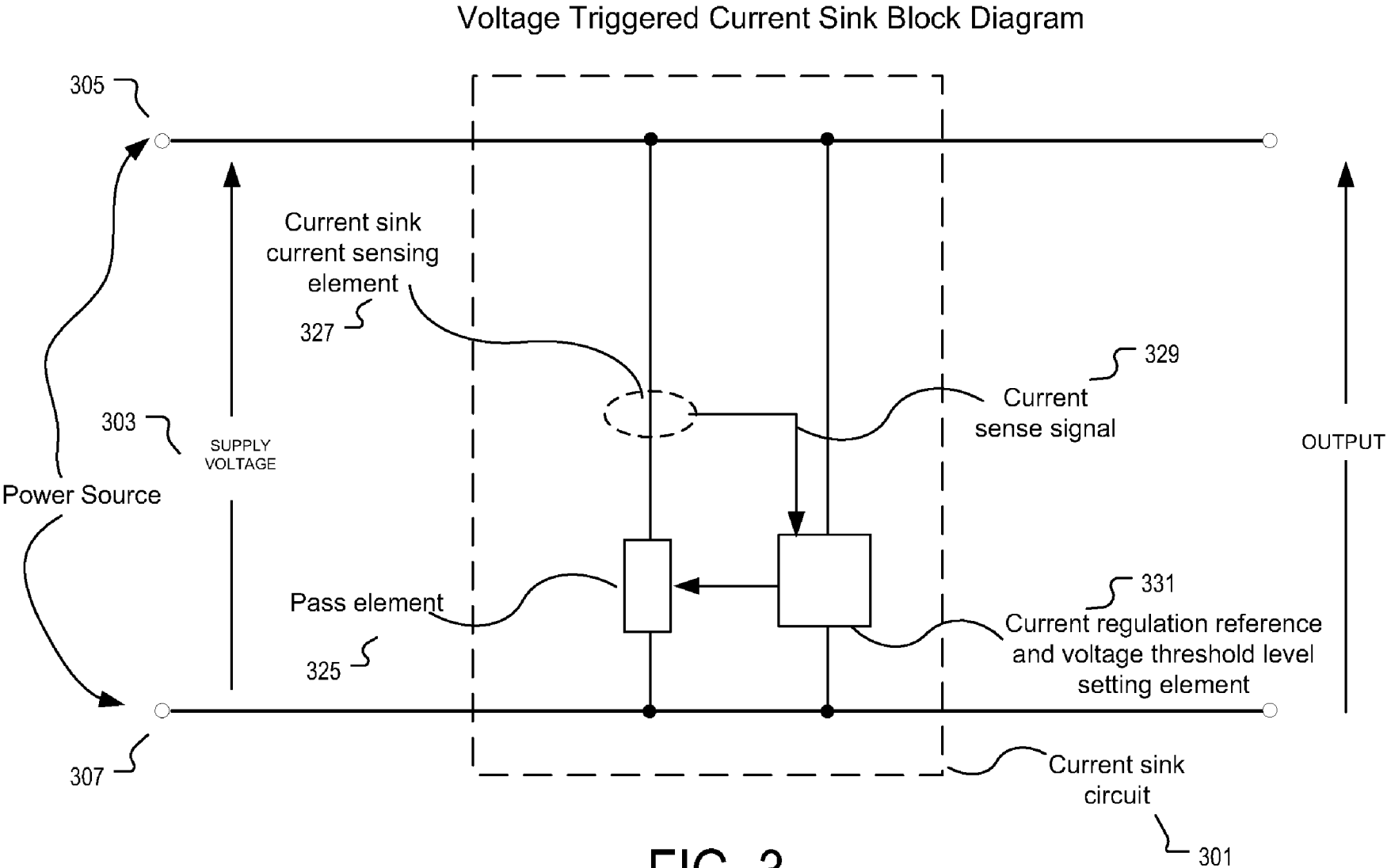
FIG. 3 is an example block diagram of a voltage triggered current sink circuit having a combined current regulation reference and voltage threshold level setting element.

FIG. 3 shows an example block diagram of a voltage triggered current sink circuit 301 in accordance with the teachings of the present invention. As shown, the current sink circuit 301 includes a current sink circuit sensing element 327, a pass element 325 coupled to the current sink circuit sensing element 327 and a current regulation reference and voltage threshold setting element 331 coupled to the pass element 325. As can be observed, the voltage threshold level setting element 209 and current regulation reference element 211 of FIG. 2 have been combined into the single current regulation reference and voltage threshold level setting element 331 of FIG. 3, which is coupled between input terminals 305 and 307 of the current sink circuit 301. Input terminals 305 and 307 are coupled to a power source to receive supply voltage 303. The current regulation reference and voltage threshold level setting element 331 provides both a voltage threshold and a current regulation reference for the current sink circuit 301 in accordance with the teachings of the present invention.

In operation, a current sense signal 329 generated by the current sink sensing element is regulated in response to the current regulation reference generated by the current regulation reference and voltage threshold level setting element 331. The current sense signal 329 is regulated by regulating a current conducted through the pass element 325 when the voltage applied across the current sink circuit 301 is above the threshold level set by the current regulation reference and voltage threshold level setting element 331. In the illustrated example, the pass element 325 passes current that is conducted through the current sink circuit 301 in response to the current regulation reference and voltage threshold level setting element 331 in accordance with the teachings of the present invention.

In the illustrated example, the current that is passed through pass element 325 and conducted through the current sink circuit 301 is substantially zero when the supply voltage 303 applied across the current sink circuit 301 is below the threshold level set by the single current regulation reference and voltage threshold level setting element 331. The current conducted through the current sink circuit 331 is regulated to the current regulation reference set by the current regulation reference and voltage threshold level setting element 331 when the voltage applied across the current sink circuit 331 exceeds the threshold level set by the single current regulation reference and voltage threshold level setting element 331 in accordance with the teachings of the present invention.

Figure 4:
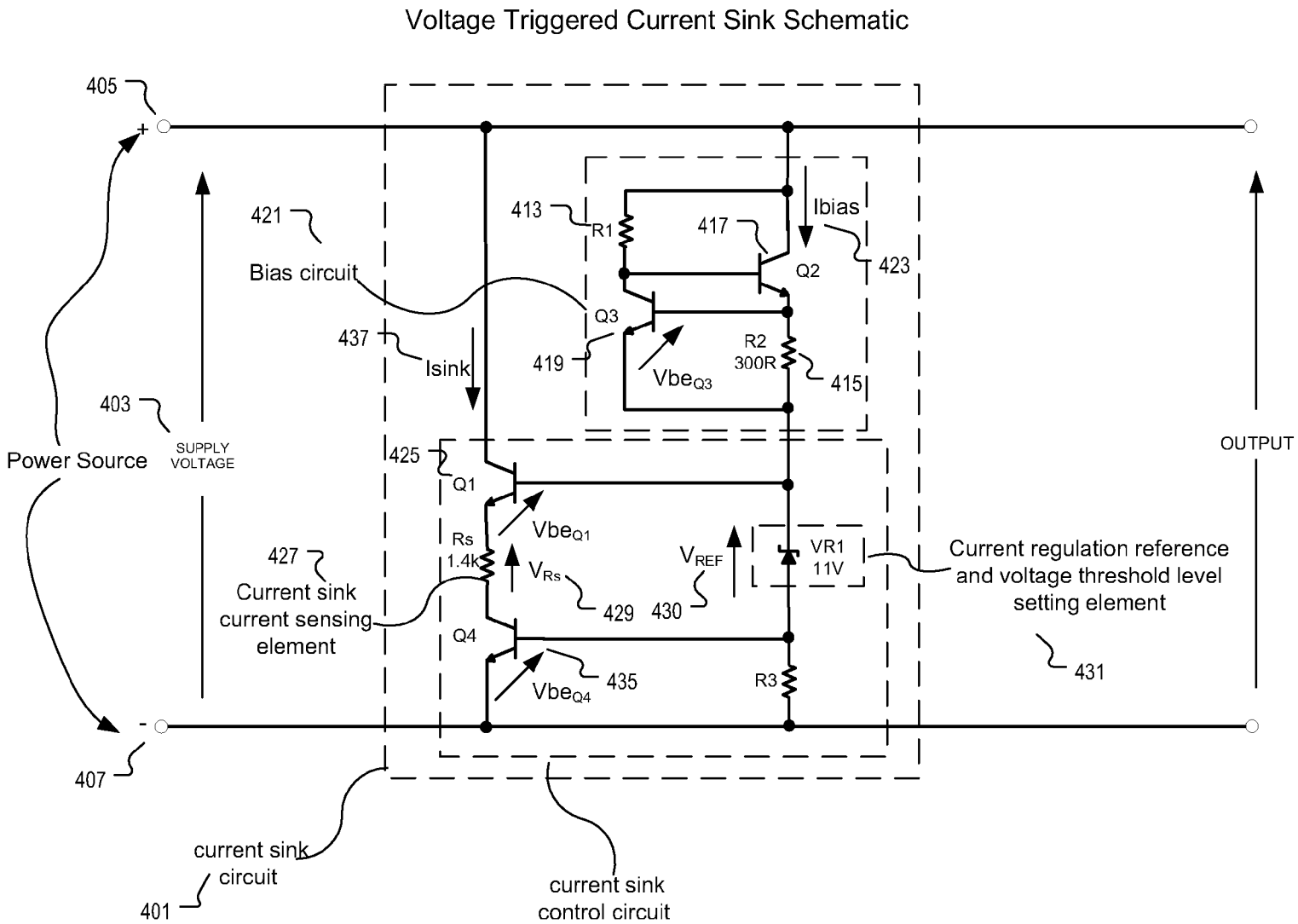
FIG. 4 is an example schematic diagram of a voltage triggered current sink circuit having a combined current regulation reference and voltage threshold level setting element.

FIG. 4 shows an example schematic of a voltage triggered current sink circuit 401 in accordance with the teachings of the present invention. Similar to the current sink circuit 301 of FIG. 3, current sink circuit 401 of FIG. 4 includes a current sink circuit sensing element 427, a pass element 425 coupled to the current sink circuit sensing element 427 and a current regulation reference and voltage threshold setting element 431 coupled to the pass element 425. In the illustrated example, the current regulation reference and voltage threshold setting element 431 includes a Zener diode VR1 such that the voltage threshold level and the current regulation reference are substantially equal to a reference voltage drop across the Zener diode VR1 during a Zener breakdown condition. In the illustrated example, the current regulation reference and voltage threshold setting element 431 is coupled to the pass element 425 through a base-emitter junction of a bipolar transistor Q1 of the pass element 425. As shown, a power source is coupled to provide a supply voltage 403 to input terminals 405 and 407. A bias circuit 421 is formed with resistors R1 413 and R2 415 and transistors Q2 417 and Q3 419 form a low cost bias current source as shown. Resistor R1 413 is coupled between the base and collector of transistor Q2 417 to provide a bias current to the base of transistor Q2 417 to initially turn on transistor Q2 417.

The current flowing through transistor Q2 417, $I_{bias}$ 423, sets up a voltage drop across resistor R2 415. In the illustrated example, the voltage across resistor R2 415 is clamped by the $V_{beQ3}$ base emitter voltage of transistor Q3 419, which in turn pulls the base emitter of transistor Q2 417 down forming a closed loop and regulating the current flowing through resistor R2 415 to the $V_{beQ3}$ base emitter voltage drop across resistor R2 415. Due to the negative temperature coefficient of transistor Q3 419 base emitter voltage $V_{beQ3}$, which in one example is approximately −2 mV/° C., the current flowing through resistor R2 415 will also exhibit a negative temperature coefficient. Bias circuit 421 provides bias current $I_{bias}$ 423 to the Zener diode VR1 of the current regulation reference and voltage threshold level setting element 431 to generate a stable reference voltage $V_{REF}$ 430 across Zener diode VR1 in accordance with the teachings of the present invention.

It is appreciated that the bias circuit 421 formed with resistors R1 413 and R2 415 and transistors Q2 417 and Q3 419 is only one example of a circuit that can be used to provide bias current $I_{bias}$ 423 and a number of alternative bias circuit configurations could be employed in accordance with the teachings of the present invention.

As shown in FIG. 4, Zener diode VR1 of the current regulation reference and voltage threshold level setting element 431 is the combined current regulation reference and voltage threshold level setting element. In the illustrated example, the main current sink current $I_{sink}$ 437 of the circuit 401 of FIG. 4 flows through transistor Q1 425, transistor Q4 435 and the current sink current sensing element resistor Rs 427. In the illustrated example, transistor Q1 425 functions as a pass element. The combined voltage drop across the Zener diode VR1, $V_{REF}$ 430, and the base emitter of transistor Q4 435, is related to the current flowing through transistors Q1 425 and Q4 435 and the current sink current sensing element 427, resistor Rs, according to the following equation:

$$V_{beQ4}+V_{REF}=V_{beQ1}+Rs\times I_{sink} \quad \text{(Equation 1)}$$

It is noted that the "Rs×$I_{sink}$" term of Equation 1 above is equal to the current sense signal 429 or $V_{RS}$ in the illustrated example. It is also noted that this ignores the small saturation voltage drop across the collector emitter of transistor Q4 435, which in one example is approximately 0.1 Volts or less, which is insignificant compared to the total voltage drop across pass element transistor Q1 425 and the current sink current sensing element resistor Rs 427, which is typically in the order of 12 Volts. The combined voltage drop $V_{REF}$ 430 across Zener diode VR1 and the base emitter voltage $V_{beQ4}$ of Q4 435 determine the threshold voltage level of supply voltage 403 at which the current $I_{sink}$ 437 starts to rise. However, in this example, the Zener voltage $V_{REF}$ 430 is referred to as the voltage threshold setting element since the base emitter voltage $V_{beQ4}$ of Q4 435 is a fixed value and the circuit designer therefore sets the voltage threshold level by choosing a Zener diode VR1 of appropriate specification to meet the needs of a specific application.

Since $V_{beQ4}$ and $V_{beQ1}$ are substantially equal in one example, $V_{REF}$ equals $V_{RS}$ and Equation 1 above can be simplified and rearranged to give:

$$I_{sink}=V_{REF}/Rs \quad \text{(Equation 2)}$$

The current sense signal $V_{RS}$ 429 generated by the current sensing element resistor Rs 427 is therefore regulated in response to the current regulation threshold $V_{REF}$ 430, by regulating the $I_{sink}$ current 437 conducted through the pass element transistor Q1 425 in accordance with the teachings of the present invention. The fact that the base emitter voltages of transistor Q1 425 and transistor Q4 435 cancel, also cancels the temperature effects of these junctions, meaning that the $I_{sink}$ 437 value is only dependent on the temperature coefficient of Zener diode VR1. Transistor Q4 435 therefore performs two key functions in the example of FIG. 4. Firstly it provides the cancellation of temperature effects of transistor Q1 425 as described above. In addition, transistor Q4 435 also ensures that the current sink circuit 401 sinks substantially zero current below the threshold voltage level. Without transistor Q4 435 in circuit, current flowing in bias circuit 421 at supply voltages below the voltage threshold level would tend to turn on transistor Q1 425, allowing some current $I_{sink}$ 437 to flow. The presence of transistor Q4 435 prevents this current flow since resistor R3 ensures that transistor Q4 435 is substantially off until the threshold voltage level is reached. In one example, Zener diode VR1 is an 11 Volt Zener diode, which has a positive temperature coefficient of approximately +7.5 mV/° C. From Equation 2 above, it is clear that the value of $I_{sink}$ 437 will also have a positive temperature coefficient. This is offset by the negative temperature coefficient of the bias circuit discussed above, which can form a relatively large percentage of the overall current sink from the power source For example, using the example component values illustrated in the schematic shown in FIG. 4, the bias circuit 421 is designed to conduct an $I_{bias}$ 423 of approximately 2.3 mA while $I_{sink}$ 437 is approximately 7.86 mA, in which case the bias circuit 421 is conducting >20% of the total current sink from the power source. In this example, therefore, the 7.86 mA value of $I_{sink}$ 437, has a positive temperature coefficient of:

$$VR1 \text{ temp coefficient}/Rs=5.4 \text{ uA/° C.} \quad \text{(Equation 3)}$$

Whereas the value of $I_{bias}$ 423 has a negative temperature coefficient of:

$$V_{beQ3} \text{ temp coefficient}/R2=-6.7 \text{ uA/° C.} \quad \text{(Equation 4)}$$

Thus, the overall current sink temperature coefficient is 5.4-6.7=−1.3 uA/° C.

Figure 5:
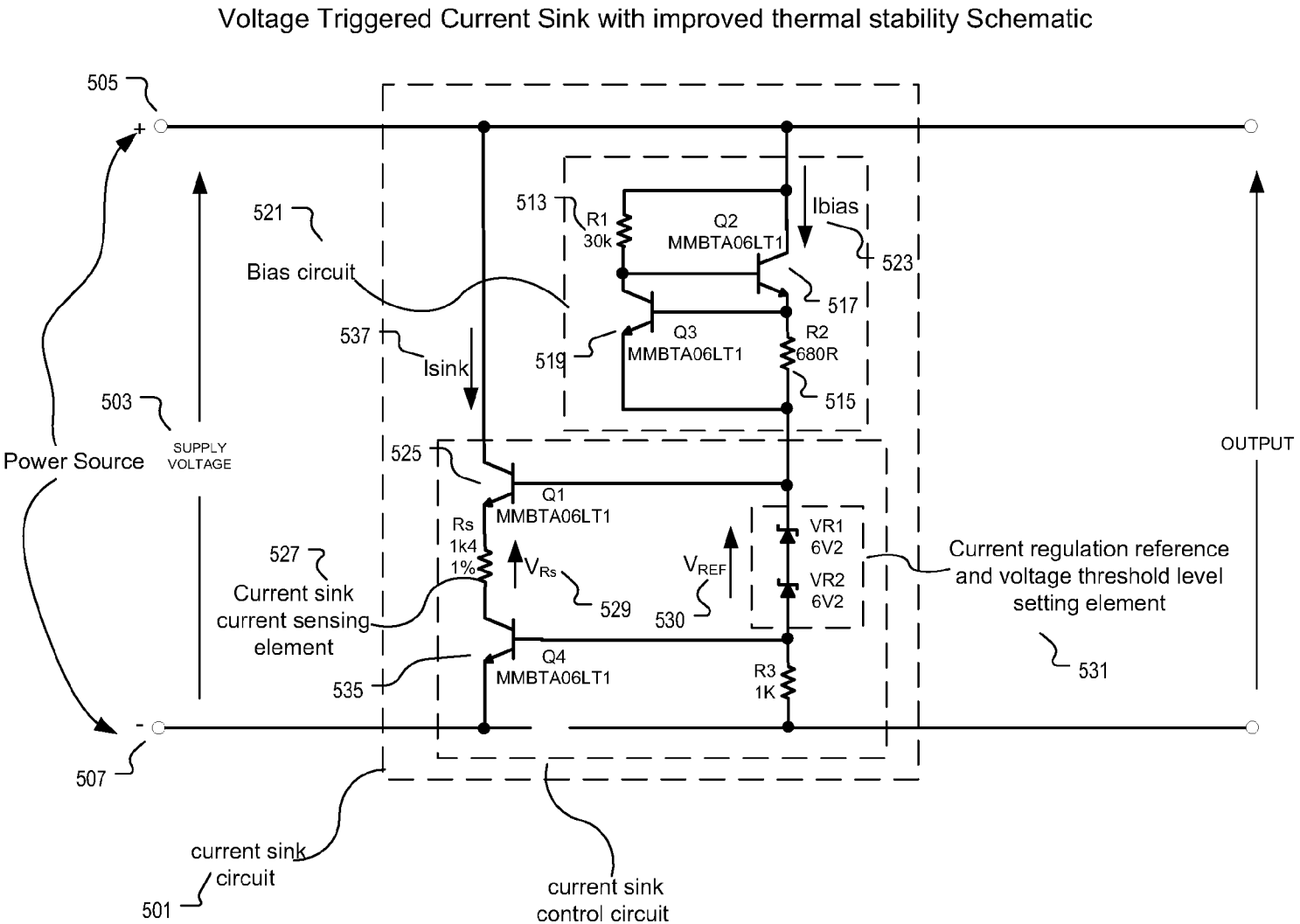
FIG. 5 shows an example schematic diagram of a voltage triggered current sink circuit having a combined current regulation reference and voltage threshold level setting element with improved temperature stability.

The design of the current sink circuit can be further refined to compensate for temperature effects as illustrated in the example schematic of a current sink circuit 501 shown in FIG. 5. As can be observed, current sink circuit 501 shares similarities and elements with current sink circuit 401 of FIG. 4. In the illustrated example, transistor Q1 525 functions as a pass element similar to transistor Q1 425 and the current sink current sensing element 527, resistor Rs, functions similar to the current sink sensing element 427, resistor Rs, of FIG. 4. One difference with the example current sink circuit 501 of FIG. 5, is that the combined current regulation and voltage threshold level setting element 531 includes at least a first Zener diode VR1 directly coupled to a second Zener diode VR2 to make use of the fact that the temperature coefficients of Zener diodes differ with their voltage ratings. Therefore, the reference voltage $V_{REF}$ 530 is the voltage drop across both of the Zener diodes VR1 and VR2 of combined current regulation and voltage threshold level setting element 531 in accordance with the teachings of the present invention.

In the example of FIG. 5 and using the same analysis as discussed above, the $I_{bias}$ 523 current has a temp coefficient of −2.9 uA/° C. In the illustrated example, the combined voltage drop $V_{REF}$ 530 across Zener diodes VR1 and VR2 has a temperature coefficient of approximately +4.2 mV/° C. As shown, each Zener diode VR1 and VR2 is a 6V2 Zener diode and has a positive temperature coefficient of +2.1 mV/° C. yielding an $I_{sink}$ 537 temperature coefficient of 4.2 mV/° C./1.4 k=3 uA/° C., almost exactly cancelling the negative temperature coefficient of $I_{bias}$ 521. In this specific example, therefore, the use of two 6V2 Zener diodes VR1 and VR2 in the combined current regulation and voltage threshold level setting element 531 as the setting element improves the temperature coefficient compared to that obtained if a single 12V Zener diode was used with the appropriate adjustment in the value of Rs in accordance with the teachings of the present invention. It is appreciated that in other examples, a plurality of Zener diodes could be directly coupled together to form the current regulation reference and voltage threshold level setting element 531 and that the example shown in FIG. 5 is only one example of the possible configurations that could be used to provide a current regulation reference and voltage threshold level setting element in accordance with the teachings of the present invention.

Figure 6:
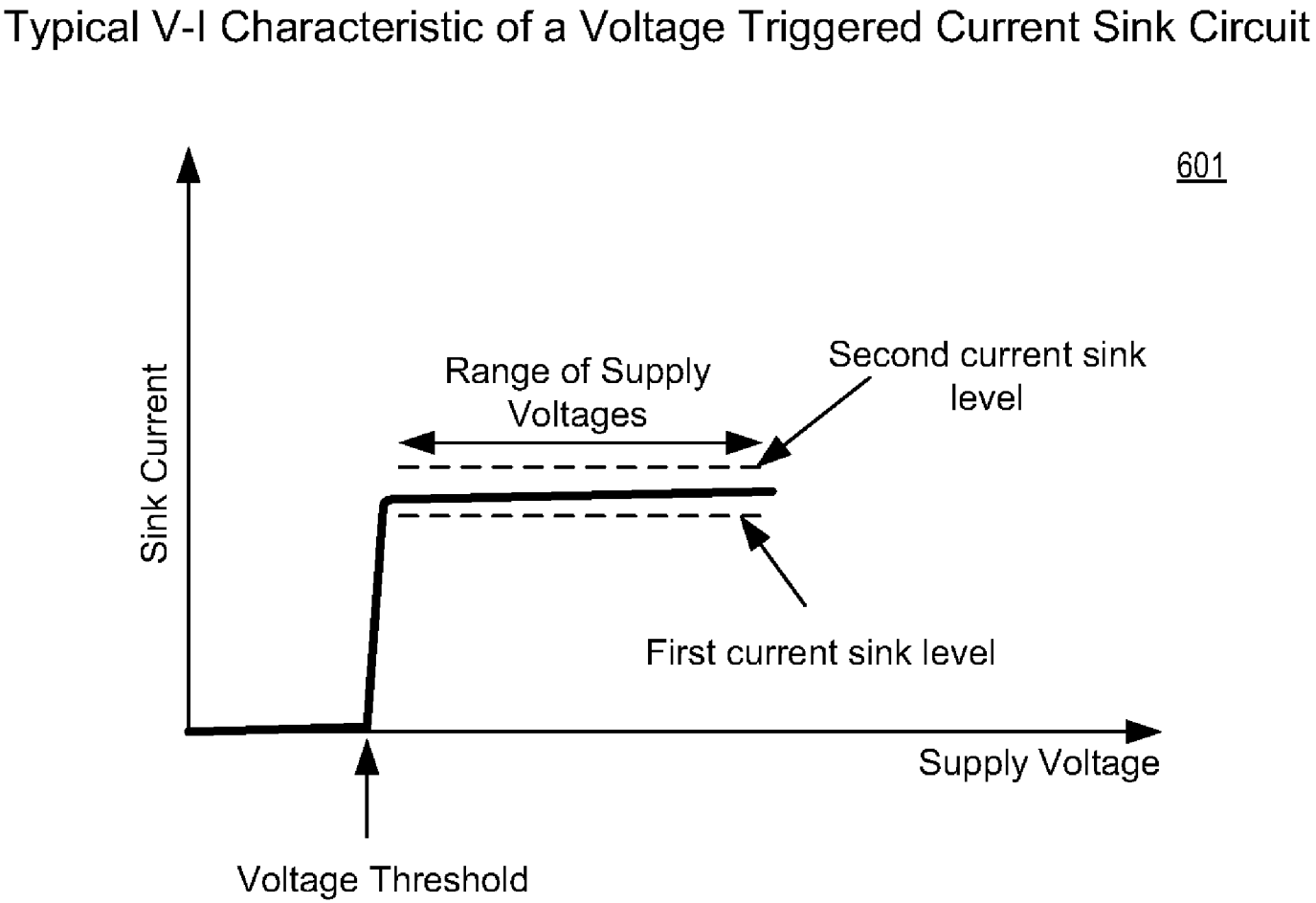
FIG. 6 shows an example V-I characteristic of a voltage triggered current sink circuit.

FIG. 6 shows a typical V-I characteristic 601 of an example voltage triggered current sink circuit according to the teachings of the present invention. The voltage threshold level is shown as the supply voltage value along the x-axis at which the level of current conducted through the current sink circuit starts to rise from a substantially zero value. The current is then regulated between a first current sink level and a second current sink value as shown along the y-axis for a range of voltages applied across the circuit that exceed the voltage threshold. In one example, the range of supply voltages could be between a first voltage of approximately 10 volts and a second voltage of approximately 30 volts applied across the current sink circuit. The first and second current sink values are associated with the combined tolerances of all the components used in the voltage triggered current sink circuit and also include the thermal coefficients of the current sink circuit discussed above in accordance with the teachings of the present invention.

As has been shown, the temperature effects can be substantially cancelled such that with the correct choice of components, the current conducted through the current sink circuit is substantially constant for a range of voltages applied across the current sink circuit when the voltage exceeds the voltage threshold in accordance with the teachings of the present invention. In such an example, the first and second current sink levels are substantially the same such that the current through the current sink circuit is regulated to a substantially constant value for the range of voltages in accordance with the teachings of the present invention.

In the foregoing detailed description, the method and apparatus of the present invention have been described with reference to a specific exemplary embodiment thereof. It will, however, be evident that various modifications and changes may be made thereto without departing from the broader spirit and scope of the present invention. The present specification and figures are accordingly to be regarded as illustrative rather than restrictive.

What is claimed is:

1. A current sink circuit, comprising:

a bias circuit coupled to provide a bias current; and a control circuit coupled to the bias circuit, wherein the control circuit includes:

a setting element coupled to receive the bias current and to generate a reference voltage in response to the bias current; and a pass element coupled to the setting element to regulate a current that is conducted through the current sink circuit in response to the reference voltage when a voltage applied across the current sink circuit is above a voltage threshold level of the setting element and wherein the current conducted through the current sink circuit is substantially zero when the voltage applied across the current sink circuit is below the voltage threshold level of the setting element.

2. The current sink circuit of claim 1, further comprising: a sensing element included in the control circuit and coupled to the pass element to provide a current sense signal representative of the current conducted through the current sink circuit.

3. The current sink circuit of claim 1, wherein the bias circuit comprises a first transistor and a second transistor, wherein a base of the first transistor is coupled to a collector of the second transistor and wherein a base of the second transistor is coupled to an emitter of the first transistor.

4. The current sink circuit of claim 3, wherein the bias circuit further comprises a first resistor and a second resistor, wherein the first resistor is coupled between a collector and the base of the first transistor and wherein the second resistor is coupled between an emitter and the base of the second transistor.

5. The current sink circuit of claim 1, wherein the setting element is a Zener diode.

6. The current sink circuit of claim 5, wherein the voltage threshold level is set by the Zener diode during a Zener breakdown condition.

7. The current sink circuit of claim 5, wherein the current that is conducted through the current sink circuit is regulated in response to the reference voltage during a Zener breakdown condition of the Zener diode.

8. The current sink circuit of claim 1, wherein the setting element comprises at least a first Zener diode coupled to a second Zener diode.

9. The current sink circuit of claim 1, wherein the current conducted through the current sink circuit is substantially constant for a range of voltages when the voltage applied across the current sink circuit exceeds the voltage threshold level.

10. The current sink circuit of claim 1, wherein the current conducted through the current sink circuit starts to rise when the voltage applied across the current sink circuit exceeds the voltage threshold level and is regulated at a substantially constant value for a range of voltages applied across the current sink circuit greater than the voltage threshold level.

11. The current sink circuit of claim 1, wherein the current conducted through the current sink circuit is regulated between a first and a second current sink level for a range of voltages applied across the current sink circuit greater than the voltage threshold level.

12. The current sink circuit of claim 11, wherein the range of voltages applied across the current sink circuit is between a first and a second voltage applied across the current sink circuit.

* * * * *